US009909294B2

(12) United States Patent
Hauth

(10) Patent No.: US 9,909,294 B2
(45) Date of Patent: Mar. 6, 2018

(54) CHECK VALVE FOR AN UPWARDLY DIRECTED DOUCHE

(71) Applicant: Neoperl GmbH, Mülheim (DE)

(72) Inventor: Mathias Hauth, Todtnau / Muggenbrunn (DE)

(73) Assignee: NEOPERL GMBH, Mullheim (DE)

( * ) Notice: Subject to any disclaimer, the term of this patent is extended or adjusted under 35 U.S.C. 154(b) by 604 days.

(21) Appl. No.: 14/385,045

(22) PCT Filed: Mar. 5, 2013

(86) PCT No.: PCT/EP2013/000630

§ 371 (c)(1),
(2) Date: Sep. 12, 2014

(87) PCT Pub. No.: WO2013/135350

PCT Pub. Date: Sep. 19, 2013

(65) Prior Publication Data

US 2015/0033464 A1 Feb. 5, 2015

(30) Foreign Application Priority Data

Mar. 13, 2012 (DE) ..... 20 2012 002 585 U

(51) Int. Cl.
*E03D 9/08* (2006.01)
*E03C 1/10* (2006.01)

(52) U.S. Cl.
CPC ..... *E03D 9/08* (2013.01); *E03C 1/102* (2013.01)

(58) Field of Classification Search
CPC ..... E03D 9/08
USPC ..... 137/215–218
See application file for complete search history.

(56) References Cited

U.S. PATENT DOCUMENTS

| | | | | |
|---|---|---|---|---|
| 2,071,044 A | | 2/1937 | Shanley | |
| 3,455,324 A | | 7/1969 | Bieri et al. | |
| 4,592,382 A | * | 6/1986 | Rubin | E03C 1/102 137/102 |
| 5,678,592 A | | 10/1997 | Boticki et al. | |
| 5,797,420 A | | 8/1998 | Nowicki et al. | |

(Continued)

FOREIGN PATENT DOCUMENTS

| | | |
|---|---|---|
| BE | 679452 A | 9/1966 |
| CH | 444076 A | 9/1967 |
| DE | 1784274 A1 | 6/1972 |

(Continued)

*Primary Examiner* — Janie Loeppke
(74) *Attorney, Agent, or Firm* — Volpe and Koenig, P.C.

(57) ABSTRACT

A backflow inhibitor has a jet nozzle connectable to a flow entrance and has a capture part which captures the liquid jet that passes over a free jet path from the jet nozzle. The capture part is connectable or connected to a flow exit and to an outlet arranged below the free jet path. The outlet discharges a partial amount of liquid not captured by the capture part. The backflow inhibitor includes an insert cartridge which carries the jet nozzle and the capture part. In use, the insert cartridge is held such that the jet nozzle is connected to the flow entrance and the capture part is connected to the flow exit. The insert cartridge, in the cartridge section which is arranged between jet nozzle and capture part and which forms or delimits the free jet path, has at least one cartridge opening that can be connected to the outlet.

10 Claims, 11 Drawing Sheets

(56) References Cited

U.S. PATENT DOCUMENTS

Figure 9:
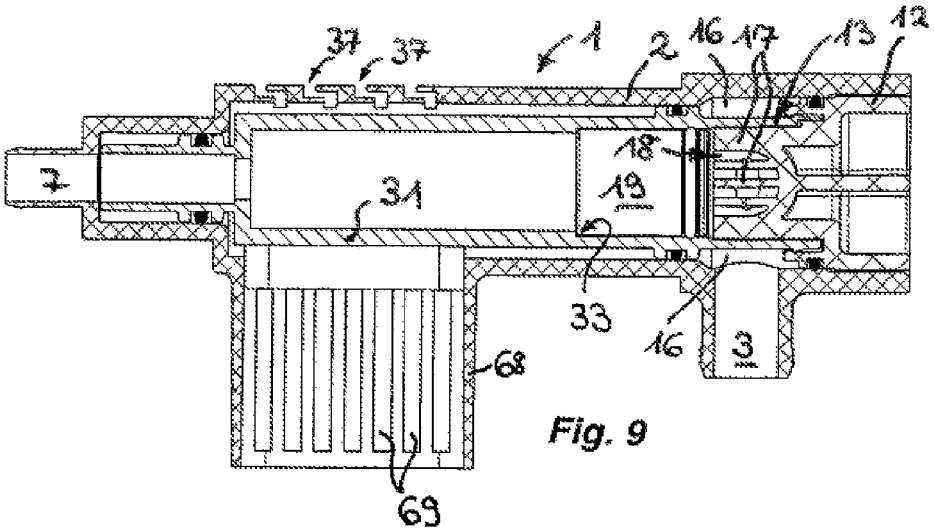

| | | | | |
|---|---|---|---|---|
| 2004/0035467 | A1 | 2/2004 | Hecking | |
| 2011/0107507 | A1* | 5/2011 | Allard | E03D 9/08 4/420.4 |

FOREIGN PATENT DOCUMENTS

| | | | |
|---|---|---|---|
| DE | 2417731 | A | 10/1975 |
| DE | 2818691 | A | 10/1979 |
| DE | 9218982 | U1 | 10/1996 |
| EP | 0785314 | A1 | 7/1997 |
| EP | 1452652 | A2 | 9/2004 |
| GB | 1166040 | A | 10/1969 |
| GB | 1498724 | A | 1/1978 |

* cited by examiner

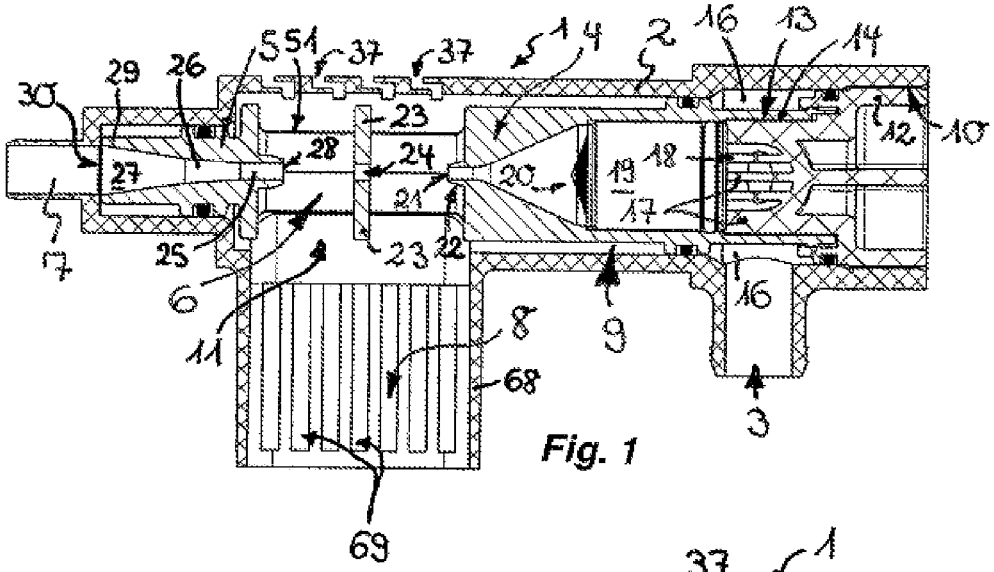
Fig. 1
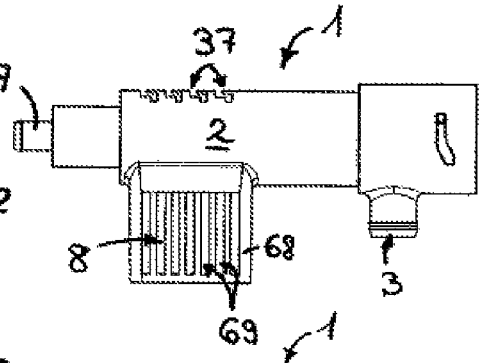
Fig. 2
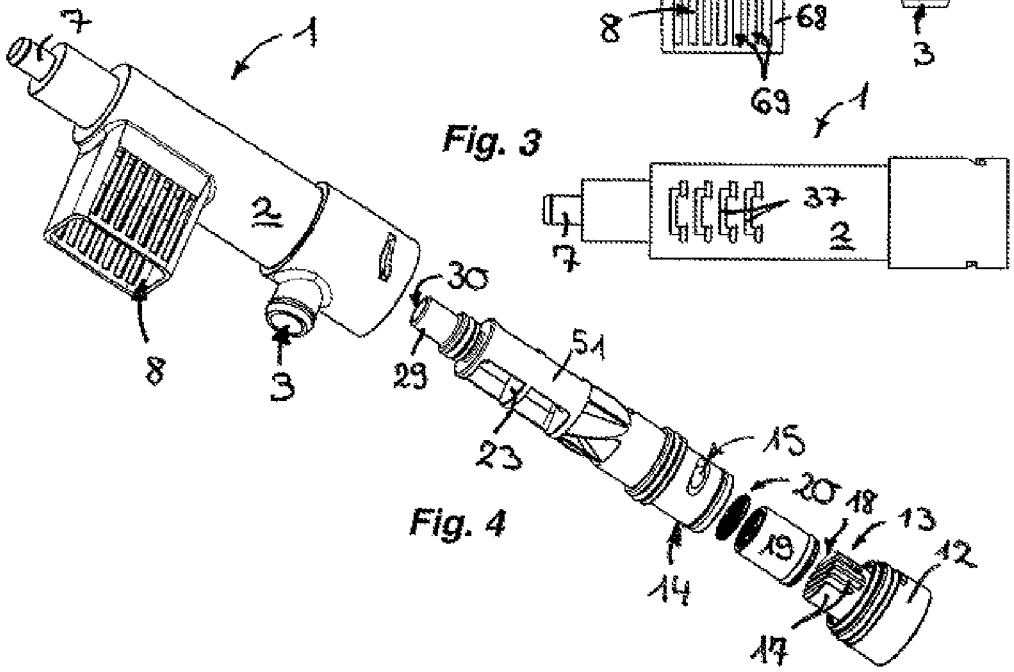
Fig. 3
Fig. 4

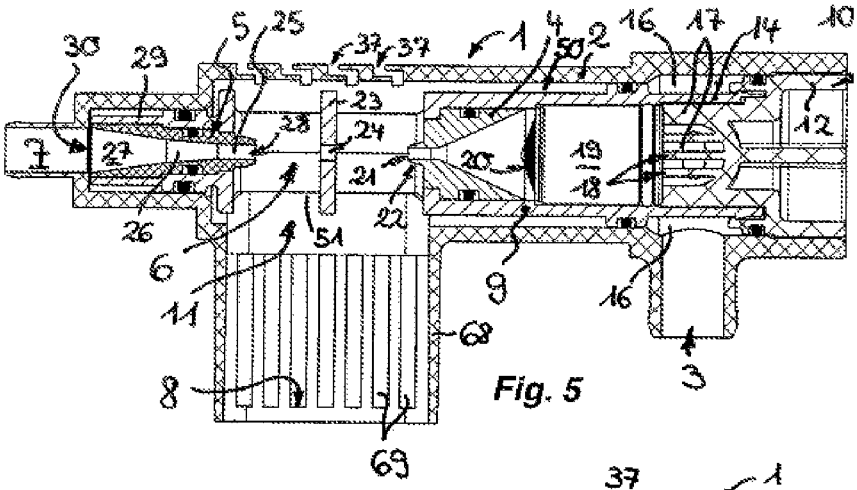
Fig. 5
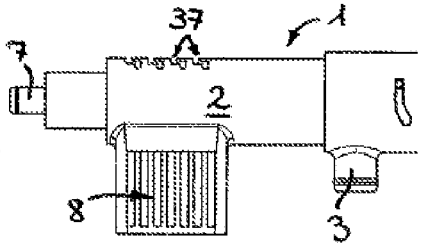
Fig. 6
Fig. 7
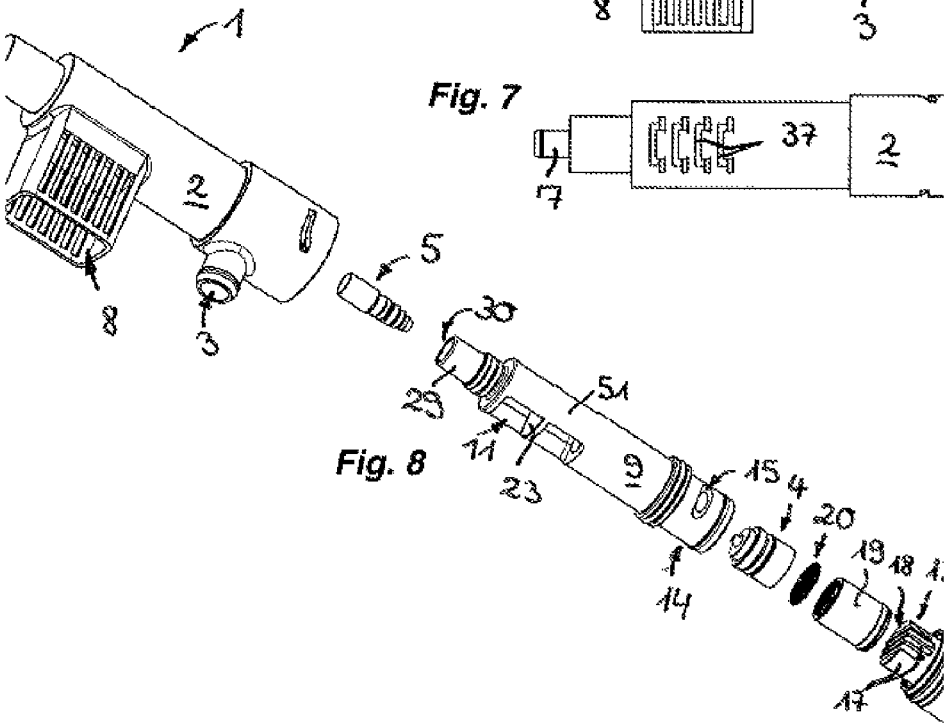
Fig. 8

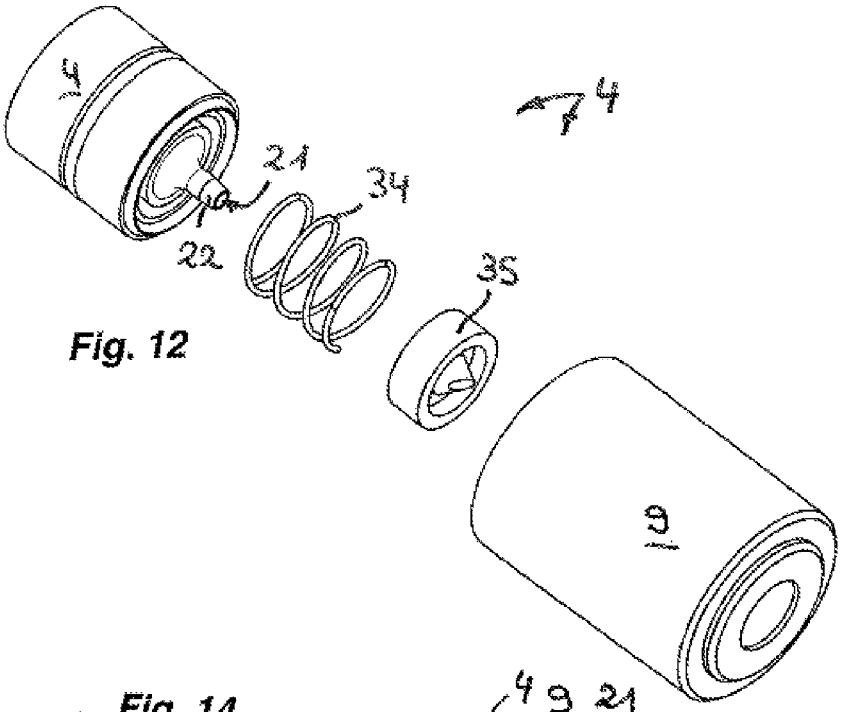
Fig. 12
Fig. 14
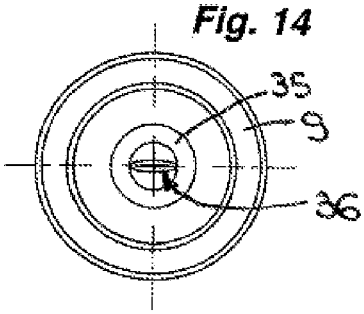
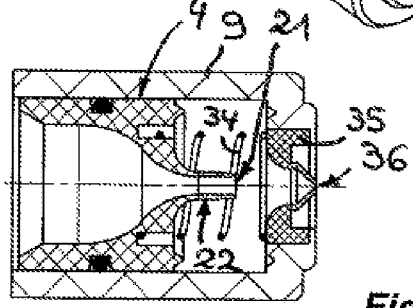
Fig. 13
Fig. 16
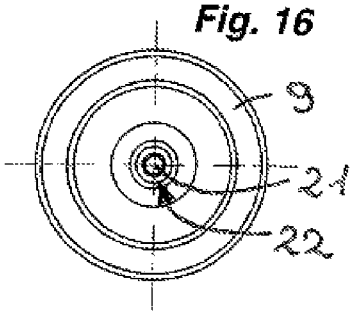
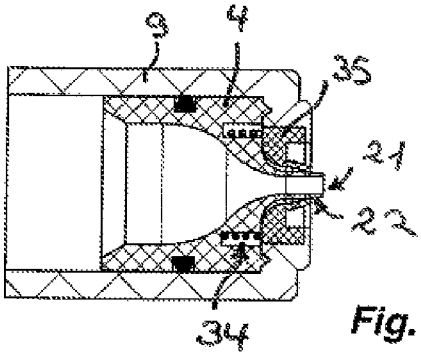
Fig. 15

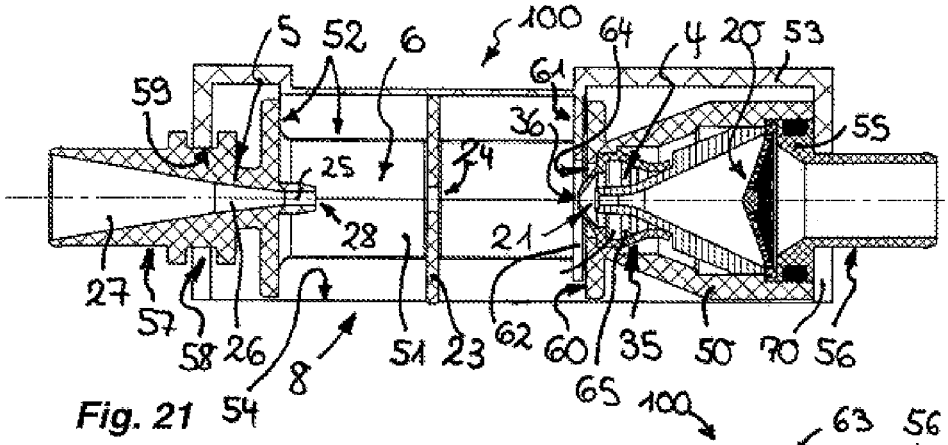
Fig. 21
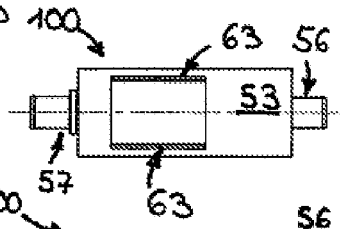
Fig. 23
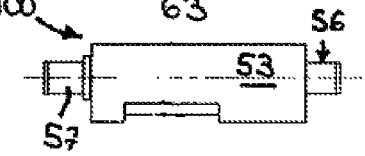
Fig. 24
Fig. 25
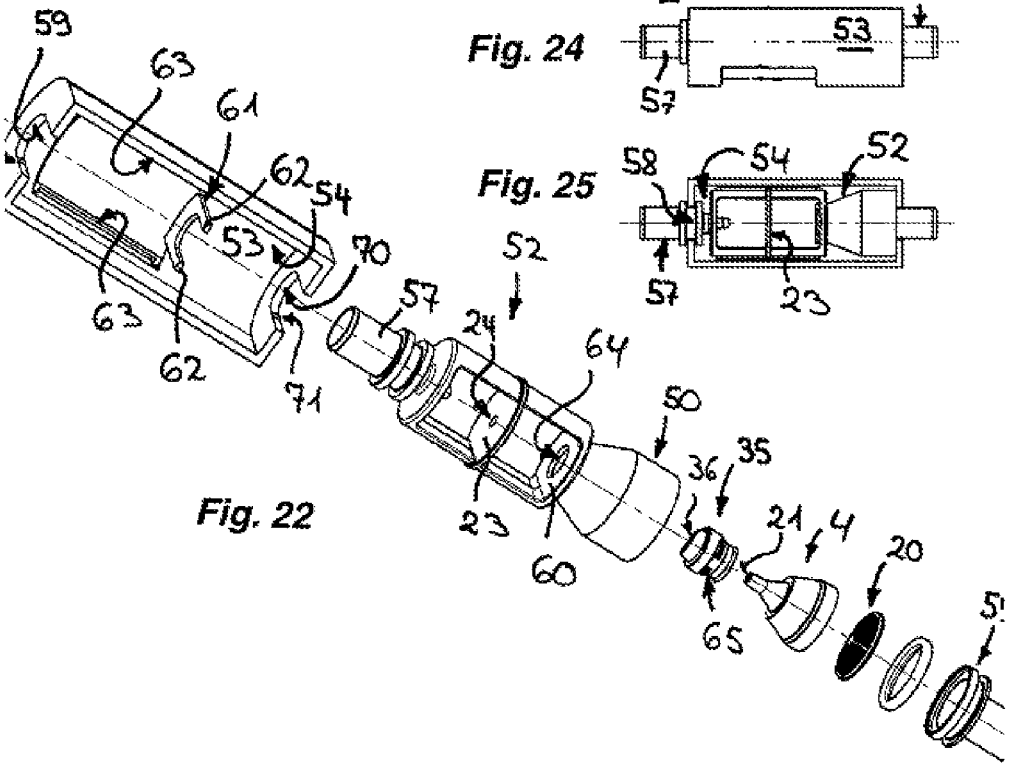
Fig. 22

CHECK VALVE FOR AN UPWARDLY DIRECTED DOUCHE

The invention relates to a backflow inhibitor which has a jet nozzle connectable to a flow entrance and has a capture part which has the task of capturing the liquid jet that passes over a free jet path from the jet nozzle, which capture part is connectable or connected to a flow exit and to an outlet arranged below the free jet path, said outlet has the task of discharging a partial amount of liquid that is not captured by the capture part.

Upwardly directed douches in water closets are operated with water from the general supply network. To protect the general supply network, from which upwardly directed douches integrated into the water closets are also supplied, against the ingress of pathogenic germs, a permanently acting backflow inhibitor is required. If the spray nozzle of an upwardly directed douche is situated in the region of the margin of the basin of a water closet bowl, then it must be assumed that the nozzle opening of said spray nozzle will become contaminated with dirty water or with excrement. Since, in the case of a direct connection to the water supply, there is the risk that, in this way, pathogenic germs can under some circumstances ingress via the shut-off valve into the drinking water supply, national and European standards and the requirements of water supply companies provide a so-called indirect connection between the general supply network and the water closet if said water closets are equipped, possibly even retroactively in the toilet seat, with an upwardly directed douche.

It is also already known for the bathtub inlet to be combined with the bathtub outlet in a tub opening in the bathtub base. Since the bathtub inlet is thus also arranged below the water surface, the bathwater can flow into the bathtub without spray water and quietly. However, since the bathwater already situated in the bathtub exerts pressure on the inflowing water and on the tub opening and thus harbors the risk of contaminated bathwater or used water flowing into the water supply network, an effective inflow safeguard and backflow inhibitor must imperatively be ensured in this exemplary embodiment too.

CH-patent 444 076 has already disclosed a backflow inhibitor of the type mentioned in the introduction. The already known backflow inhibitor has a housing in which a jet nozzle is provided. To be able to connect the jet nozzle to the general drinking water supply network, the jet nozzle can be connected to a housing flow entrance. Also provided in the housing is a capture part which has the task of capturing the liquid jet that passes over a free jet path. To be able to conduct the water, which is captured again at the capture part, to the spray nozzle of an upwardly directed douche, the capture part in the housing can be connected to a housing flow exit. Below the jet path situated between the jet nozzle and capture part, there is arranged a housing outlet which has the task of discharging from the housing interior a partial amount of liquid that is not captured by the capture part.

In the case of these backflow inhibitors, which are also referred to in the standards as "free outlet with injector", the pressure energy of the water flowing in from the supply network is converted, in the region of the jet nozzle, into kinetic energy in order to bring the water jet into contact with the atmosphere over the short free jet path and in order to subsequently convert the kinetic energy of the water jet at least partially into pressure energy again in the region of the capture part, also referred to as diffuser, said pressure energy being required, for example, for the cleaning jet of upwardly directed douches. To be able to realize the conversion of the pressure energy into kinetic energy and subsequently back again without relatively great energy losses, and in order to generate a homogeneous and calm water jet in the region of the free jet path, the jet nozzle and the capture part must be adapted to one another and to the specific conditions of the respective supply network. It is a disadvantage that, although the already known backflow inhibitors are optimized with regard to the conditions prevailing in a particular supply network, said backflow inhibitors possibly cannot ensure optimum functioning under conditions deviating therefrom. Here, it must always be ensured in an effective manner that the mains network does not become contaminated with dirty water.

A jet erroneously directed to the side of the capture opening of the capture part may, upon impact, generate spray such that contaminated liquid droplets are inadvertently also flung back into the region of the jet nozzle. It is thus also an object to provide a backflow inhibitor of the type mentioned in the introduction, with which it is ensured that a jet erroneously directed to the side of the capture opening of the capture part does not generate spray such that contaminated liquid droplets are inadvertently also flung into the region of the jet nozzle and can contaminate said region.

To achieve said object, one invention proposal that is independently worthy of protection provides that, in the free jet path, at a distance from the jet nozzle and from the capture part, there is arranged at least one spray wall or partition, said spray wall or partition has a jet passage opening which has a clear opening cross section larger than the jet cross section of the liquid jet. If a jet is inadvertently erroneously directed to the side of the capture opening of the capture part, said erroneously directed jet component can at most generate spray back to the spray wall or partition, but said spray wall or partition provides effective protection for the jet nozzle region situated behind it. In this way, inadvertent contamination in the region of the jet nozzle owing to liquid droplets being flung back is reliably prevented. The spray wall or partition does not have the task of focusing the liquid jet passing from the jet nozzle, for which reason the jet passage opening provided in the spray wall or partition should have a clear opening cross section which is slightly larger than the jet cross section of the liquid jet.

Here, an embodiment is preferred in which the clear opening cross section of the jet passage opening is dimensioned such that the liquid jet passes through said jet passage opening without being focused by the latter, and passes through said jet passage opening just without making contact.

In order that the spray wall or partition can capture, in an effective manner, the water droplets that are not captured by the capture part, it is advantageous for the spray wall or partition to be at a distance of at least four millimeters from the capture part at one side and from the jet nozzle at the other side.

Since a spray wall or partition at an insufficient distance from the nozzle opening of the jet nozzle can lead to an undesired widening of the liquid jet, an embodiment is preferred in which the spray wall or partition, which is provided at a distance between the jet nozzle and capture part, is arranged closer to the capture part.

In the case of the backflow inhibitor of the type mentioned in the introduction, it is also an object to optimize the interaction of jet nozzle, nozzle opening, capture part and capture opening. The optimum coordination of said components is crucial in order to prevent excessive pressure losses and in order to prevent unnecessarily intense spraying of the liquid jet. In particular, the construction and geometry of the capture part and of its capture opening are also of great significance here, which capture opening must capture the liquid jet in an effective manner.

In addition to, or independently of, the features described above, it is thus also an object to provide a backflow inhibitor of the type mentioned in the introduction, the capture part of which can capture the liquid jet without relatively great energy and pressure losses.

Said object is achieved according to the invention, in the case of the backflow inhibitor of the type mentioned in the introduction, in particular in that the capture part has a capture opening which, at least in its inflow-side section, has a hollow cylindrical clear opening cross section.

In order that the kinetic energy, which is transmitted over the free jet path by means of the liquid jet, can be converted again within the capture part into the water pressure required at the upwardly directed douche, it is expedient if, adjacent to its hollow cylindrical section, the capture part widens in the direction of the flow exit.

A particularly advantageous refinement according to the invention provides that the capture part has, on the outflow side of the hollow cylindrical section, at least one subsection which is conical or which widens in arcuate fashion in terms of clear cross section, and that there are preferably at least two adjoining subsections, of which the inflow-side subsection widens to a lesser degree than the subsequent subsection. It has surprisingly been found that a capture part designed correspondingly in terms of its clear cross section is distinguished by effective energy conversion. Here, those subsections of the capture opening which are provided on the outflow side of the hollow cylindrical section may be separated from one another by clearly identifiable boundary lines, or may merge into one another via smooth transitions.

An optimized geometric adaptation of jet nozzle and capture part provides that the jet nozzle and the capture part are coordinated with one another in terms of their dimensions in accordance with the following formula:

$$\frac{\text{Diameter of the capture opening}}{\text{Diameter of the nozzle opening of the jet nozzle}} = Q_1,$$

with the specification that the quotient $Q_1$ amounts to 1 to 5, preferably 1.05 to 2.0 and in particular 1.05 to 1.34.

For the same reason, a further proposal according to the invention provides that the length $l_1$ of the hollow cylindrical subsection of the capture part and the opening cross section of the capture opening are coordinated in accordance with the following formula:

$$\frac{\text{Length}(l_1)\text{of the hollow cylindrical subsection of the capture part}}{\text{Diameter}(d)\text{of the capture opening}} = Q_2,$$

with the specification that the quotient $Q_2$ amounts to at least 0.2 and at most 10, and preferably at least 1.5 and at most 2.6.

The optimized coordination between the jet nozzle and the capture part can be adversely affected if dirt or limescale deposits form in particular on the nozzle opening of the capture part. Such limescale deposits are possible if the water droplets that remain on the nozzle opening of the jet nozzle evaporate and a lime residue originally contained in the water is left behind. In addition to, or independently of, the features described above, it is thus also an object to provide a backflow inhibitor of the type mentioned in the introduction, which can be operated with relatively low maintenance and with which, in particular, the risk of limescale deposits is reduced.

Said object is achieved according to the invention, in the case of the backflow inhibitor of the type mentioned in the introduction, in particular in that the jet nozzle is guided displaceably in the backflow inhibitor and is displaceable from a standby position into a spray position, in which spray position the jet nozzle extends, by way of its nozzle section bordering a nozzle opening, through a push-through opening which is provided in an elastic diaphragm or is closed by a flap in the standby position.

In the case of this backflow inhibitor designed in accordance with the invention proposal, the jet nozzle is guided displaceably in the backflow inhibitor and can be displaced from a standby position into a spray position. Whereas, in the spray position, the jet nozzle extends, by way of its nozzle section bordering a nozzle opening, through a push-through opening which is provided in an elastic diaphragm or is closed by a flap in the standby position, in the standby position the jet nozzle is covered by the elastic diaphragm or the flap, such that evaporation that leads to limescale deposits occurs to a lesser extent.

To permit displaceable guidance of the jet nozzle in the backflow inhibitor, and to make it possible for a backflow inhibitor of said type to be produced in as simple a manner as possible, one preferred embodiment of the invention provides that a sleeve-shaped jet nozzle receptacle is provided in which the jet nozzle is displaceably guided, and that the jet nozzle receptacle is connected to the capture part via at least one connecting web.

It has been found that the marginal region bordering the nozzle opening should as far as possible be of sharp-edged design in order that a non-sputtering liquid jet emerges from the jet nozzle. During the production process, however, there is the risk of said sharp-edged design of the marginal region bordering the nozzle opening being impaired by external influences. To counteract such damage to the sharp-edged marginal region, one preferred embodiment of the invention provides that, on the jet nozzle, there is integrally formed an annular projection which surrounds the nozzle opening.

The generation of an energy-rich and non-sputtering liquid jet in the jet nozzle is promoted if the opening margin that borders the nozzle opening of the jet nozzle is of sharp-edged form, and is for this purpose formed without a bevel or rounding.

Here, one preferred exemplary embodiment of the invention provides that said opening margin of the nozzle opening has an edge degree of less than 0.1 mm or greater than −0.1 mm.

An optimized outflow of the liquid jet from the jet nozzle is promoted if the jet nozzle has a hollow cylindrical clear cross section in the region of its nozzle opening.

To counteract evaporation-induced limescale deposits in the region of the nozzle opening of the jet nozzle, one preferred refinement according to the invention provides that, in the standby position, the jet nozzle is, in the region of the nozzle opening, arranged in a water bath or surrounded by water, and that, for this purpose, the flap or the diaphragm closes the push-through opening preferably in a fluid-tight manner in the standby position. Since it is the case that, in the standby position, the jet nozzle is, by way of its nozzle opening, arranged in a water bath or surrounded by water, evaporation-induced limescale deposits on the nozzle opening of the jet nozzle are counteracted in an effective manner. The jet nozzle is pushed out of the water bath, or out of the water that surrounds it in the standby position, only when the jet nozzle, in the spray position, extends through the push-through opening which is provided in the elastic diaphragm or is closed by a flap in the standby position.

The sliding movement of the jet nozzle between the standby position and the spray position can be realized with the aid of a motor drive. However, a particularly simple and thus preferred embodiment of the invention provides that the jet nozzle can be displaced from the standby position into the spray position counter to a restoring force.

One preferred refinement of the invention provides, instead of a motor drive, that the jet nozzle is displaceable under the pressure of the liquid flowing through.

Here, for the restoring force, at least one restoring spring may be provided, in particular if it is the intention for the push-through opening to be closed by a flap in the standby position. However, a particularly simple and thus preferred embodiment of the invention provides that the restoring force is generated by the inherent elasticity, which preferably acts on the jet nozzle, of the material used for the diaphragm.

To make it possible for an adequate restoring force to be exerted on the jet nozzle that is guided displaceably in the jet nozzle receptacle, it is advantageous if the jet nozzle projects into a pot-shaped diaphragm which bears the passage opening on a pot base of its pot shape, and if the circumferential margin, remote from the pot base, of the diaphragm is supported in resiliently elastic fashion against the jet nozzle.

A preferred embodiment of the invention provides that the diaphragm, in the region of the pot base of its pot shape, seals off the jet nozzle receptacle in the region of an opening provided in the guide wall, and that the diaphragm, at the circumference of its pot shape, has at least one throughflow opening which connects the interior of the jet nozzle receptacle to the interior of the pot-shaped diaphragm. The sliding movement of the jet nozzle takes place counter to the inherent elasticity of the diaphragm. Since the diaphragm, in its circumferential marginal region that acts on the jet nozzle, must have an adequate free space available for diaphragm deformation, and since the sliding movement of the jet nozzle can be hindered by an amount of water that is sealingly partitioned off by means of the diaphragm, it is always also necessary during the sliding movement to ensure adequate compensation for the water that is situated in the jet nozzle receptacle. Since the diaphragm has at least one throughflow opening on the circumference of its pot shape, which throughflow opening connects the interior of the jet nozzle receptacle to the interior of the pot-shaped diaphragm, a build-up of a partial amount of water, which hinders the sliding movement of the jet nozzle, is counteracted.

In addition to or independently of the features mentioned above, in the case of the backflow inhibitor mentioned in the introduction, it is also an object to provide a backflow inhibitor which, in a simple manner, can be connected upstream, at the inflow side, of a sanitary point of use, and which can, with little outlay, be adapted to a wide variety of predefined conditions such that said backflow inhibitor is distinguished by optimum functioning. Here, the backflow inhibitor according to the invention should be easy to clean, and should also be capable of being descaled with little expense if required.

Said object is achieved according to the invention, in the case of the backflow inhibitor of the type mentioned in the introduction, in particular in that an insert cartridge is provided which bears the jet nozzle and the capture part, in that the insert cartridge, when in a usage position, is held such that the jet nozzle is connected to the flow entrance and the capture part is connected to the flow exit, and in that the insert cartridge, in the cartridge section which is arranged between jet nozzle and capture part and which forms or delimits the free jet path, has at least one cartridge opening that can be connected to the outlet.

The backflow inhibitor designed in accordance with this invention proposal has an insert cartridge, which insert cartridge has a jet nozzle connectable to a flow entrance and has a capture part connectable to a flow exit. While the jet nozzle is connected via the flow entrance to the general supply network, the capture part conducts the water via the flow exit to a sanitary point of use or to a similar water outlet. Here, the insert cartridge, when in a usage position, is held such that the jet nozzle is connected to the flow entrance and, at the same time, the capture part is connected to the flow exit. The insert cartridge, in the cartridge section which is arranged between the jet nozzle and capture part and which delimits the free jet path, has at least one cartridge opening that can be connected to the outlet. By releasing the insert cartridge and exchanging said insert cartridge, the backflow inhibitor according to the invention, which can be connected upstream, at the inflow side, of a toilet seat, a ceramic toilet bowl or for example a bathtub, can be adapted with little outlay to a wide variety of predefined conditions, such that optimum functioning is always ensured. By releasing the insert cartridge, the backflow inhibitor according to the invention is easy to clean and is also easy to descale if required.

Here, one preferred embodiment of the invention provides that the insert cartridge can be inserted into an insertion opening of a cartridge receptacle and can preferably be detachably fixed there such that the jet nozzle is connected to the flow entrance of the cartridge receptacle and the capture part is connected to the flow exit of the cartridge receptacle, and that the insert cartridge has, in the cartridge section which is arranged between the jet nozzle and capture part and which forms or delimits the free jet path, at least one cartridge opening that can be connected to the outlet of the cartridge receptacle.

Said cartridge receptacle may be formed into a toilet seat or into a bathtub or may be formed as a housing which can be inserted into the toilet seat or into the bathtub and which is for example in the form of a plastic part. It is however also possible for the backflow inhibitor designed in accordance with one or more of the above invention proposals to be connected upstream of a point of use connected to the mains water network, in order, in an effective manner, to counteract bacterial contamination of the water stored in the mains water network. Such an exemplary embodiment can be advantageously used in particular in the hospital sector, where transmission of germs should be counteracted.

Here, the jet nozzle and the capture part which interacts with said jet nozzle and which is likewise provided in the insert cartridge may readily also be designed such that the backflow inhibitor according to the invention is practically free from leakage even in the region of the jet path.

The insert cartridge can be pushed into the backflow inhibitor according to the invention in the correct position in a simple manner if the insert cartridge can be inserted into an insertion opening of a cartridge receptacle and can preferably be detachably fixed such that the jet nozzle is connected to the flow entrance and the capture part is connected to the flow exit of the cartridge receptacle.

To make it possible for the insert cartridge to be inserted into the cartridge receptacle through the insertion opening and for the cartridge receptacle to be closed off in liquid-tight fashion, it is advantageous if the insertion opening can be closed off by means of a cap, to which cap the insert cartridge can be detachably fixed or is non-detachably connected. In order to be inserted, the insert cartridge can be gripped and handled by way of the cap. It is expedient here if the insert cartridge can be fixed to the cap in terms of its relative position at least in a direction of rotation and possibly also in a longitudinal direction, such that positioning in the cartridge receptacle is ensured at the same time.

Ease of handling of the backflow inhibitor according to the invention is promoted if the cap is preferably detachably held in the region of the cartridge receptacle by means of a screw connection or a bayonet connection or similar push/turn connection.

The insert cartridge or the insert housing can be fixed to the cap in a simple manner if the cap has a cap extension onto which the insert cartridge can be pushed or mounted by way of a cartridge end region which is open at the face side.

A preferred embodiment of the invention provides that the insert cartridge has at least one inlet, which can be connected to the flow entrance of the cartridge receptacle via an annular chamber which is bounded between the inner circumference of the cartridge receptacle and the cartridge outer circumference and which is sealed off in an encircling manner on both sides in the longitudinal direction of the cartridge receptacle. In this preferred embodiment, by simply inserting and fixing the insert cartridge in the cartridge receptacle, the connection of the jet nozzle to the flow entrance of the cartridge receptacle is realized at the same time. Here, the water flowing into the cartridge receptacle via the flow entrance of the cartridge receptacle flows around the insert cartridge in the region of the annular space, so as to be able to flow from there through the at least one inlet into the insert cartridge and into the jet nozzle situated therein.

To make it also possible for a relatively high flow rate of water to flow into the insert cartridge with uniformly high pressure, it is expedient if the insert cartridge has two inlets, and if the flow entrance of the cartridge receptacle opens out at the annular chamber in a manner uniformly spaced from the cartridge inlets in the circumferential direction.

One preferred refinement of the invention provides that the inlets are arranged on opposite sides, and approximately at the same level, on the cartridge circumference.

It is particularly advantageous if, between the two inlets of the insert cartridge, there is provided at least one flow-guiding wall and preferably multiple flow-guiding walls that run in lamellar fashion with respect to one another, and if a passage opening is preferably arranged between two adjacent flow-guiding walls in the direction of the jet nozzle.

To make it possible for the capture part to be connected to the flow exit of the cartridge receptacle, which leads to a sanitary point of use, for example to an upwardly directed douche or to a bathtub, in as simple a manner as possible when the insert cartridge is inserted into the cartridge receptacle, one particularly simple and advantageous embodiment of the invention provides that the capture part ends or opens out in a cartridge flow exit or similar outlet arranged at the face-side cartridge end, that the outlet is provided adjacent to the flow exit of the cartridge receptacle, and that the insert cartridge is, in the region of its cartridge end that has the outlet, sealed off in encircling fashion with respect to the inner circumference of the cartridge receptacle.

In the case of the backflow inhibitor described in the introduction, a further object consists in making it possible for a backflow inhibitor of said type to be located in the region of a sanitary point of use even retroactively if required.

In addition to or independently of the features described above, said object is achieved according to the invention, in a manner that is independently worthy of protection, in that the sleeve-shaped jet nozzle receptacle is connected via at least one connecting web to the capture part to form an insert element, in that the insert element can be inserted into a shell-shaped housing, which for this purpose has an insertion opening on a longitudinal side, in that the insert element can be detachably fixed in the shell-shaped housing such that the insertion opening forms the outlet, and in that the sleeve-shaped jet nozzle receptacle can be closed off, at its face side remote from the jet nozzle, by means of a cover which bears a connection nipple, or similar inlet, which can be connected to the flow entrance.

According to this invention proposal, the backflow inhibitor according to the invention of the type mentioned in the introduction has a shell-shaped housing into which an insert element can be inserted. Here, the sleeve-shaped jet nozzle receptacle, on the one hand, and the capture part, on the other hand, are connected to one another by way of at least one connecting web to form the insert element. To be able to insert the insert element into the shell-shaped housing, the housing has an insertion opening on the longitudinal side. The insert element can be detachably fixed in the shell-shaped housing such that the insertion opening forms the outlet. The sleeve-shaped jet nozzle receptacle can be closed, at its face side remote from the jet nozzle, by means of a cover which bears a connection nipple or similar inlet that can be connected to the flow entrance. Since the sleeve-shaped jet nozzle receptacle can be closed by means of the cover, said jet nozzle receptacle can also be opened such that the jet nozzle guided displaceably in the jet nozzle receptacle can be easily inserted. Since the backflow inhibitor formed from the housing and from the insert part that can be inserted therein forms a functionally reliable unit of particularly small construction, said unit can be connected into the water feed line even retroactively on a bathtub, a ceramic toilet bowl, a toilet seat or in the region of some other sanitary point-of-use.

In order that, with regard to the housing, there is always a distance, conforming to standards, between the outlet and a support that is acted on by the housing, it is expedient if, on the housing, there is integrally formed at least one spacer and preferably multiple spacers which ensure a minimum distance from the insertion opening provided as outlet.

In order that the backflow inhibitor situated in a cartridge receptacle or in a housing can dry out quickly after every use, it is advantageous if the cartridge receptacle or the housing has at least one aeration opening on the circumference of the cartridge receptacle or of the housing, in the region of the free jet path, outside the outlet, and preferably on the side remote from the outlet.

To restrict contamination with dirt in the interior of the cartridge receptacle or of the housing, and to prevent escape of spray water, it is expedient if the at least one aeration opening is in the form of an aeration slot provided in labyrinthine form in the wall of the cartridge receptacle or of the housing.

In the case of the housing described above, one preferred embodiment provides that the housing carries the at least one aeration opening on the longitudinal side remote from the insertion opening.

To provide a labyrinthine profile of the aeration openings even in the case of the backflow inhibitor provided with a housing, it is advantageous if the housing has two slot-shaped aeration openings which are oriented in the housing longitudinal direction, and if the connecting webs of the insert element situated in the housing project into an imaginary plane through the slot-shaped aeration openings.

To protect the backflow inhibitor according to the invention, in the region of its jet nozzle, against contaminated liquid droplets that are inadvertently sprayed back when the liquid jet impinges on the capture part, it is advantageous if the spray wall or partition substantially fills the clear cross section of the cartridge or housing interior.

In order to connect the backflow inhibitor according to the invention to a shower head or similar point-of-use in a simple manner, and in order to simultaneously ensure correct positioning of the components situated in the backflow inhibitor according to the invention, it is advantageous if a connection nipple or similar outlet is integrally formed on the capture part for the purposes of connecting the capture part to the flow exit, and if, on the capture part and outlet, there is provided on the outer circumference a groove into which a wall opening, which is open toward the insertion opening, on the housing face side of the housing engages.

To ensure the correct positioning of the components relative to one another such as is crucial for the functioning of the backflow inhibitor according to the invention, it is advantageous if a guide wall is integrally formed on the outer side of the jet nozzle receptacle, said guide wall being engaged on on both sides by in each case one connecting web, if a fork-shaped holder projects into the housing interior of the housing, and if, in a usage position, the guide wall bears against the holder, which is arranged between the connecting webs, such that the forks of the holder are arranged on both sides of, and at a distance from, the push-through opening.

It is possible for the spray wall or partition to be produced as a separate component and to subsequently be fastened retroactively to the at least one connecting web. An embodiment is however preferable in which the spray wall or partition is formed integrally on the at least one connecting web. Such an embodiment promotes simple production of the backflow inhibitor according to the invention with few constituent parts.

Firm hold of the backflow inhibitor in the housing interior and correct positioning of the backflow inhibitor in the housing are promoted if the cover that closes off the jet nozzle receptacle bears, in the usage position, against the inner side of the adjacent housing face side of the housing, if that, in this state, the connection nipple or similar inlet integrally formed on the cover extends through a holding opening, which is open toward the insertion opening, on the housing face side.

In order that the insert element can be fixed in the housing interior in an easily detachable but nevertheless adequately secure manner, it is advantageous if the holding opening and/or the wall opening has, at least on one side in the insertion direction, an offset by way of which the one or more connection nipples can be detachably locked. If the holding opening or the wall opening has offsets of said type on both sides of its opening outline, the opening outline has approximately the contour of a keyhole intended for a mortise key.

A particularly advantageous refinement of the invention provides that at least one of the following functional elements is provided between the at least one inlet and the jet nozzle: flow rate regulator, backflow preventer or screen. In order to generate an optimum water jet in the jet nozzle independently of fluctuating pressure conditions in the supply network, it is advantageous if a flow rate regulator is arranged between the cartridge or housing inlet and the jet nozzle, which flow rate regulator regulates and limits the amount of water flowing through per unit of time to a value optimum for the jet nozzle and capture part. To prevent a backflow of possibly contaminated water into the supply network with additional certainty, it is advantageous if a backflow preventer is provided between the at least one cartridge or housing inlet and the jet nozzle.

An embodiment of the invention which is particularly easy to handle provides that at least one of the functional elements: flow rate regulator, backflow preventer or screen is a constituent part of an insert cartridge, and the insert cartridge can preferably be inserted, from the jet nozzle receptacle open at the face side, into the latter. Here, the insert cartridge may possibly also comprise two backflow preventer which are connected in series but which are independent in terms of their function.

It is particularly advantageous if, between the one or more backflow preventer and/or the flow rate regulator, at one side, and the jet nozzle, at the other side, there is provided at least one screen or at least one grate for homogenizing the pressure conditions across the clear cross section in the region of the jet nozzle. Said grate or screen is of fine-mesh form such that it homogenizes pressure gradients which arise across the cross section of the water flow and which may be caused for example by the internal structures in a backflow preventer or in a flow rate regulator.

In order that the pressure of the liquid entering from the supply network can be converted into the highest possible level of kinetic energy in the region of the jet nozzle, it is provided that the flow guide preferably narrows in funnel-shaped form in the direction of the nozzle opening of the jet nozzle.

To counteract a widening of the liquid jet, it is expedient if the jet nozzle projects in nipple-like or stud-like form in the region of the nozzle opening. If the nozzle opening of the jet nozzle projects in nipple-like or stud-like form, a situation is thus simultaneously prevented in which spray water droplets that run off can pass transversely through, and disrupt, the jet. Here, the nipple-like or stud-like jet nozzle may also be retracted and bordered by an encircling groove or recessed portion.

In order that the capture part can capture, practically without leakage, the liquid jet that arrives via the jet path, it is advantageous if that section of the capture part which borders the capture opening also projects in nipple-like or stud-like form. By means of this nipple-like or stud-like projecting configuration at the outer circumference of the capture opening, a situation is prevented here, too, in which spray water droplets that run off can pass transversely through, and disrupt, the jet.

Preferred exemplary embodiments for the backflow inhibitor designed in accordance with at least one of the inventions described above provide that the backflow inhibitor is positioned upstream, at the inflow side, of a sanitary point of use, and that the sanitary point of use is preferably an upwardly directed douche or a base-side water inlet of a wash basin or of a bathtub. The backflow inhibitor according to the invention may however also be connected upstream, for example, of points-of-use provided in a hospital, in order to reliably prevent contamination of the mains water with germs.

Refinements of the invention will also emerge from the claims in conjunction with the following description of the figures.

The invention will be described in more detail below on the basis of preferred exemplary embodiments.

Figure 10:
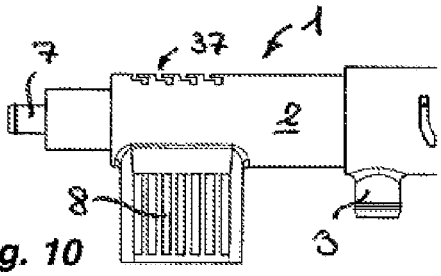
Figure 11:
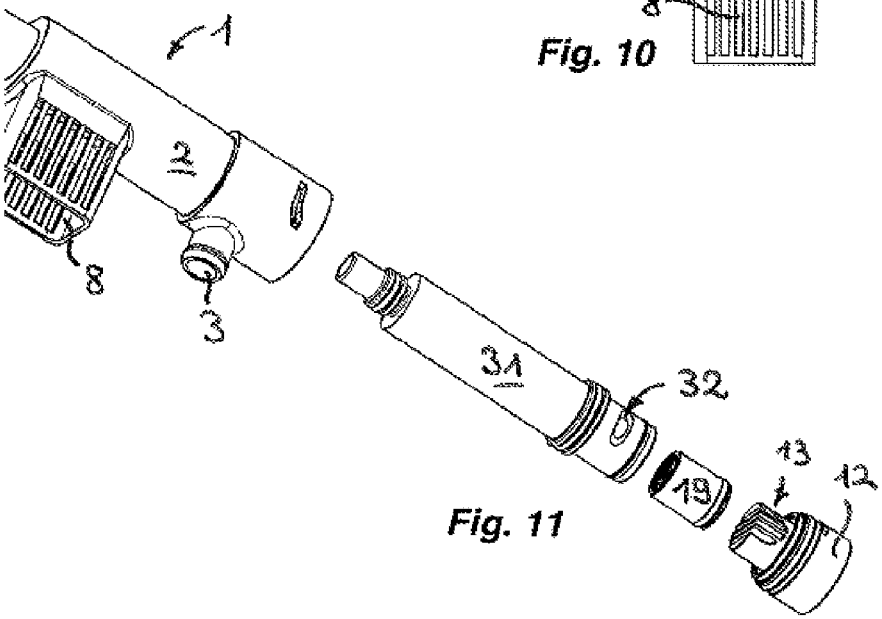
Figure 17:
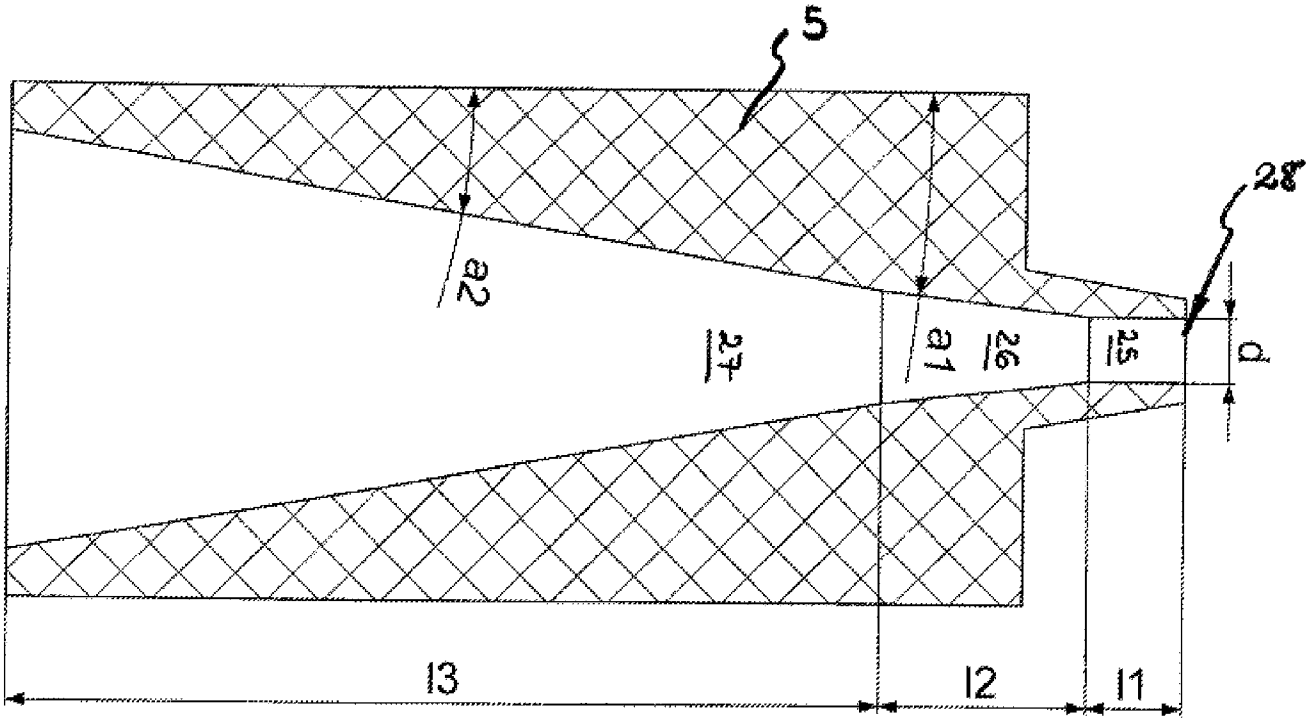
Figure 18:
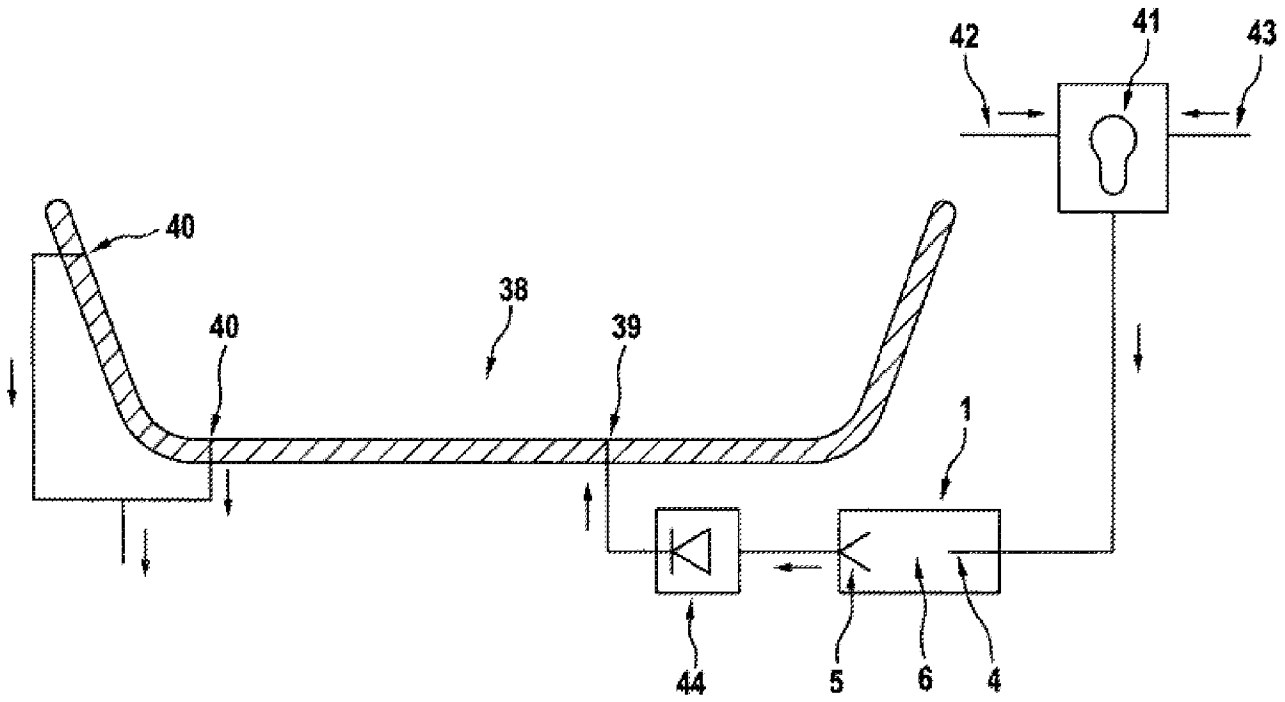
Figure 19:
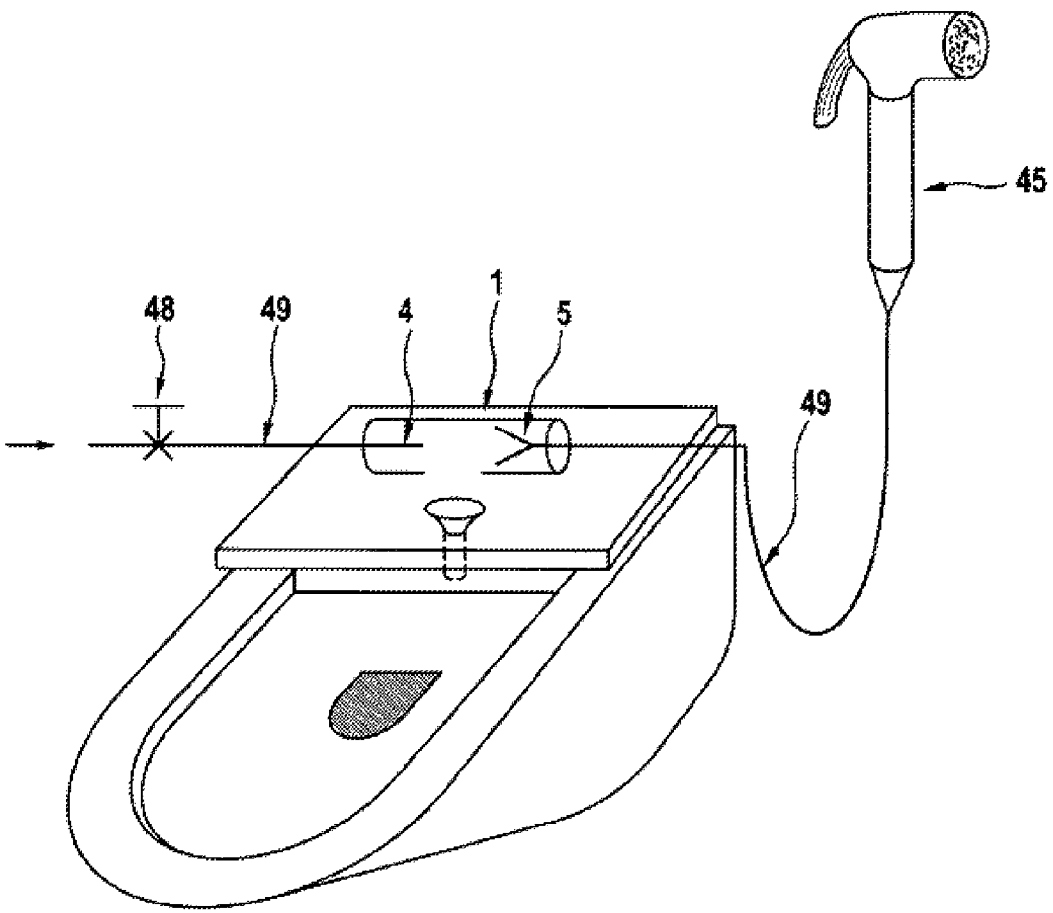
Figure 20:
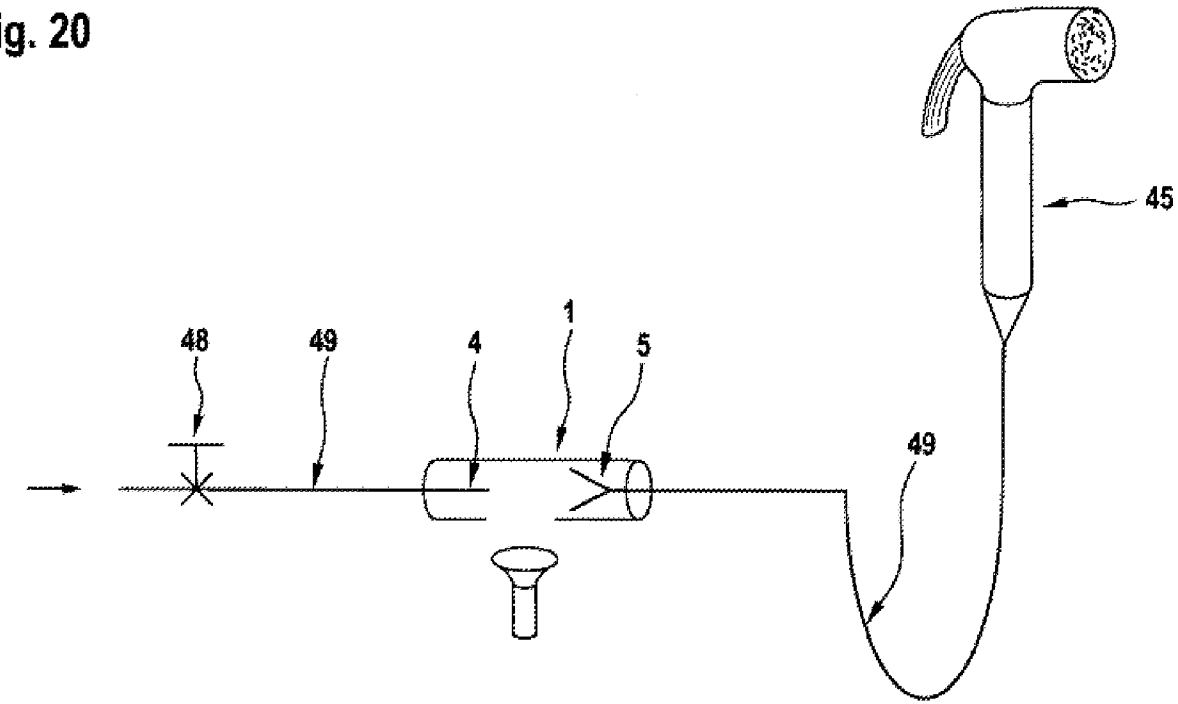
Figure 27:
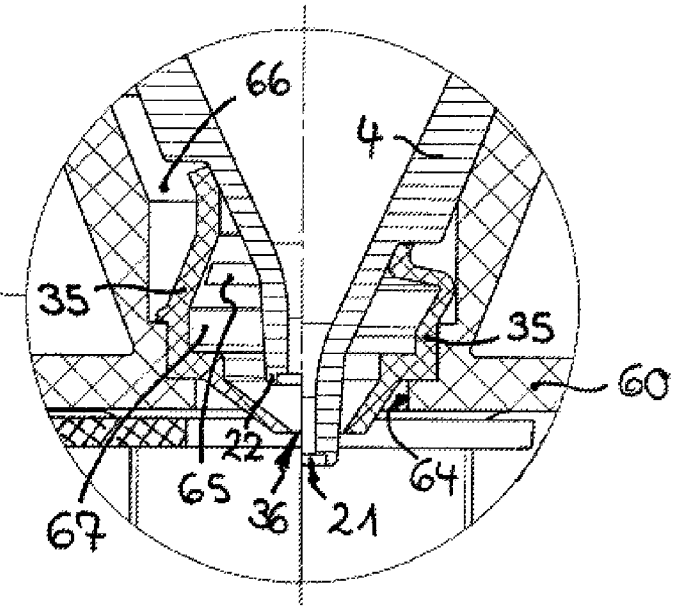
Figure 26:
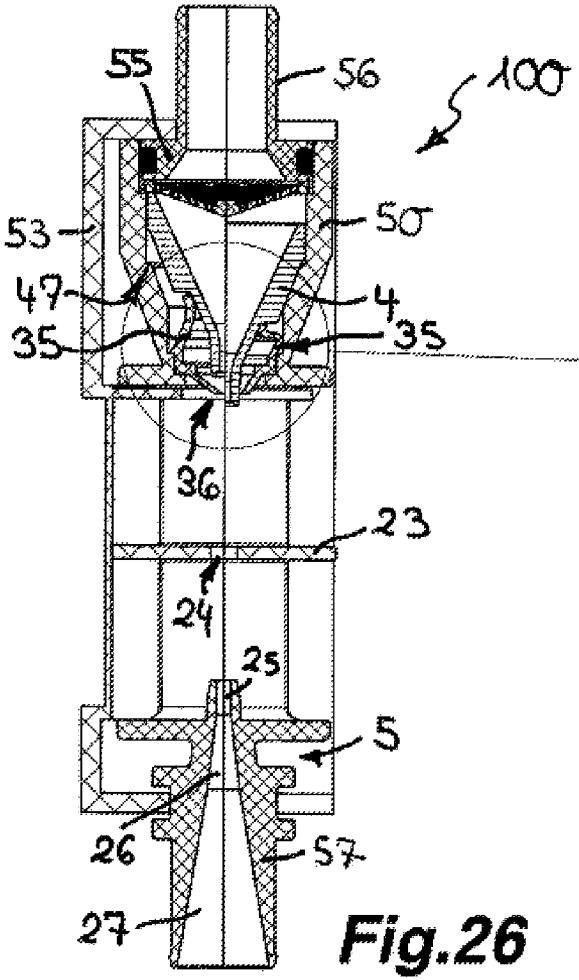
Figure 30:
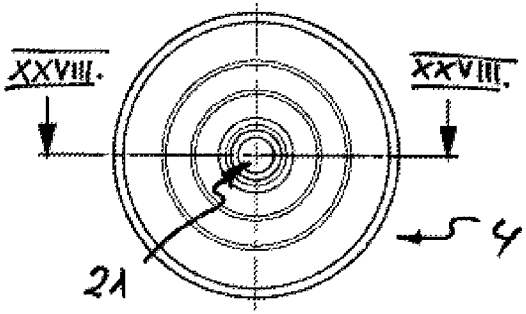
Figure 28:
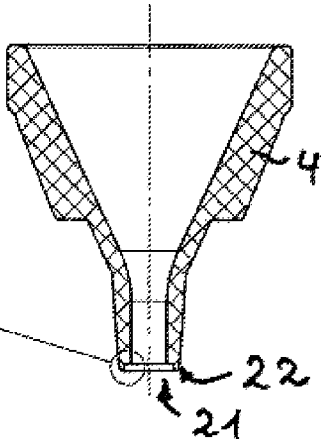
Figure 29:
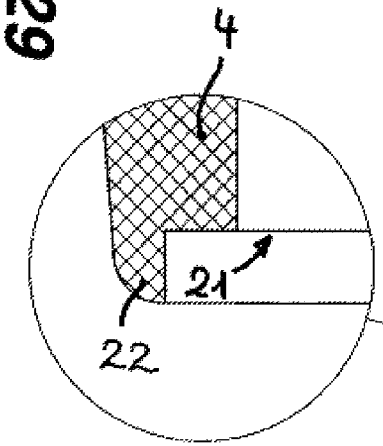

In the figures:

FIG. 1 shows, in a longitudinal section, a backflow inhibitor having a cartridge receptacle into which there is inserted an insert cartridge, the latter bearing a jet nozzle and a capture part which captures the jet passing from the jet nozzle over a free jet path, FIG. 2 shows the backflow inhibitor from FIG. 1 in a side view, FIG. 3 shows the backflow inhibitor from FIGS. 1 and 2 in a plan view, FIG. 4 shows the backflow inhibitor from FIGS. 1 to 3 in an exploded illustration of its main constituent parts, FIG. 5 shows a backflow inhibitor, of similar design to that in FIGS. 1 to 4 and likewise illustrated here in a longitudinal section, in which the jet nozzle provided on the insert cartridge and the capture part are formed as separate components, FIG. 6 shows the backflow inhibitor from FIG. 5 in a side view, FIG. 7 shows the backflow inhibitor from FIGS. 5 and 6 in a plan view, FIG. 8 shows the backflow inhibitor from FIGS. 5 and 7 in an exploded illustration of its main constituent parts, FIG. 9 shows, in a longitudinal section, a backflow inhibitor in which the insert cartridge has been exchanged for a tubular connecting piece, wherein the backflow inhibitor illustrated here can prevent a backflow at most by way of an integrated backflow preventer, FIG. 10 shows the backflow inhibitor from FIG. 9 in a side view, FIG. 11 shows the backflow inhibitor from FIGS. 9 and 10 in an exploded illustration of its main constituent parts, FIG. 12 shows a jet nozzle for a backflow inhibitor as per FIGS. 1 to 8 in a perspective illustration of its main constituent parts, FIG. 13 shows the jet nozzle from FIG. 12 in a longitudinal section, wherein the jet nozzle is guided displaceably in a sleeve-shaped jet nozzle receptacle such that said jet nozzle can, in a spray position, extend by way of its projecting nozzle opening through the push-through opening of a diaphragm, wherein here, the jet nozzle is shown in its standby position in which it is retracted into the sleeve-shaped jet nozzle receptacle, FIG. 14 shows the jet nozzle, situated in the standby position, in a plan view of the diaphragm to be extended through by the jet nozzle, FIG. 15 shows the jet nozzle from FIGS. 12 to 14 with the nozzle opening in the spray position, illustrated here in longitudinal section, FIG. 16 shows the jet nozzle from FIGS. 12 to 15 in an end view of the jet opening projecting beyond the push-through opening of the diaphragm, FIG. 17 shows the backflow inhibitor in a schematic longitudinal section in the region of its capture part, FIG. 18 shows a backflow inhibitor designed according to FIGS. 1 to 17, which is here connected upstream, at the inflow side, of the water inlet in the tub base of a bathtub, FIG. 19 shows a backflow inhibitor which is connected into the water flow entrance of an upwardly directed douche that can be mounted, also retroactively, on a toilet seat or ceramic toilet bowl, FIG. 20 shows, in a schematic illustration, the water guide of the upwardly directed douche shown in FIG. 19, which has a hand-held shower referred to as a "shattaf shower", wherein the interposed backflow inhibitor can be seen in the water flow entrance, FIG. 21 shows a further embodiment of a backflow inhibitor in a longitudinal section, wherein the backflow inhibitor shown in FIG. 21 is of a similar design to the backflow inhibitor shown in FIGS. 1 to 18, FIG. 22 shows the backflow inhibitor from FIG. 21 in a perspective illustration of its individual parts, FIG. 23 shows the backflow inhibitor from FIGS. 21 and 22 in a plan view of the outlet of said backflow inhibitor, FIG. 24 shows the backflow inhibitor shown in FIGS. 21 and 23, in a side view, FIG. 25 shows the backflow inhibitor from FIGS. 21 to 24, in a plan view of the top side, which faces away from the outlet, FIG. 26 shows the backflow inhibitor, in this case likewise in longitudinal section, from FIGS. 21 to 25, wherein, in this backflow inhibitor, a jet nozzle is provided which is guided displaceably counter to a restoring force, said jet nozzle being shown here in two sliding positions, FIG. 27 shows the backflow inhibitor from FIGS. 21 to 26, with its displaceably guided jet nozzle in the sliding positions illustrated alongside one another, FIG. 28 shows the jet nozzle of the backflow inhibitor shown in FIGS. 21 to 27, in a longitudinal section, FIG. 29 shows the spray nozzle of the backflow inhibitor shown in FIGS. 21 to 27, in the region of its nozzle opening, and FIG. 30 shows the jet nozzle from FIGS. 28 and 29, in a plan view of the nozzle opening.

FIGS. 1 to 30 illustrate a backflow inhibitor 1, 100 in various embodiments, which can be connected upstream, at the inflow side, of a sanitary point of use, for example an upwardly directed douche or the bathtub inlet of a bathtub. Said backflow inhibitor 1, 100 is intended to reliably prevent a backflow of contaminated water into the drinking water supply network.

The backflow inhibitor 1 illustrated in FIGS. 1 to 20 has a cartridge receptacle 2 which can be integrated, for example, into a cutout of suitable shape on the toilet seat. As is clear from a comparison of FIGS. 1 to 8, there is provided in the cartridge receptacle 2 a jet nozzle 4, which can be connected to a flow entrance 3 of the cartridge receptacle 2, and a capture part 5, which captures the liquid jet that passes over a free jet path 6 from the jet nozzle 4. Whereas the jet nozzle 4 is connected to the drinking water supply network via the flow entrance 3 of the cartridge receptacle 2, the capture part 5 is connected via a flow exit of the cartridge receptacle 2 to a spray nozzle (not shown in any more detail) or to the hand-held shower 45, shown in FIGS. 19 and 20 and referred to as a "shattaf shower", of an upwardly directed douche. Below the free jet path 6, over which the water is guided as a water jet exposed to the atmosphere, there is provided an outlet 8 of the cartridge receptacle 2, said outlet having the task of discharging from the interior of the cartridge receptacle 2 a partial amount of liquid that is not captured by the capture part 5. Formed integrally on the cartridge receptacle 2 there is a spacer 68 which ensures that there is a minimum distance, conforming to standards, between the outlet 8 and a backwater level situated downstream of said outlet in the flow direction. Said spacer 68 is of approximately sleeve-shaped form in cross section and has, on both of its longitudinal sides, throughflow openings 69 which are oriented in the longitudinal extent of the spacer 68. Said throughflow openings 69 which are provided on both longitudinal sides of the spacer 68 give the spacer 68 a cage-like appearance.

The backflow inhibitors 1 shown in FIGS. 1 to 8 are allocated an insert cartridge 9 which carries the jet nozzle 4 and the capture part 5. Said insert cartridge 9 can be inserted through an insertion opening 10 for example into the cartridge receptacle 2 illustrated in FIG. 1 and can be detachably fixed therein such that the jet nozzle 4 is connected to the flow entrance 3 of the cartridge receptacle 2. It is clear from FIGS. 1 and 5 that the insert cartridges 9, in their cartridge section which is arranged between jet nozzle 4 and capture part 5 and which forms or delimits the free jet path 6, have at least one cartridge opening 11 which is connected to the outlet 8 of the cartridge receptacle 2. In the case of the insert cartridge 9 illustrated here, the cartridge opening 11 and the outlet 8 of the cartridge receptacle 2 directly adjoin one another.

The insertion opening 10 through which the insert cartridge 9 can be inserted into the interior of the cartridge receptacle 2 can be closed by means of a cap 12 to which the insert cartridge 9 can be detachably fixed. Here, the cap 12 is detachably held on the cartridge receptacle 2 by way of a push-turn connection, wherein the push-turn connection may for example be in the form of a bayonet or similar bayonet-type connection.

The cap 12 has a cap extension 13 onto which the insert cartridge 9 can be pushed or mounted by way of its adjacent cartridge end region 14 which is open at the face side.

The insert cartridge 9 can thus be handled easily, even under restricted space conditions, by way of the cap 12 that is accessible from the outside at all times.

The insert cartridge 9 has at least one inlet 15 which can be connected to the flow entrance 3 of the cartridge receptacle 2 via an annular chamber 16 which is bounded between the inner circumference of the cartridge receptacle 2 and the cartridge outer circumference and which is sealed off in an encircling manner on both sides in the longitudinal direction of the cartridge receptacle 2. Here, the insert cartridge 9 has two oval inlets 15 oriented in the cartridge circumferential direction. The flow entrance 3 of the cartridge receptacle 2 opens out in the annular chamber 16 in a manner uniformly spaced from the inlets 15 in the circumferential direction, said inlets in this case being arranged on opposite sides at the same level.

From a comparison of FIGS. 1 and 5 on the one hand and FIGS. 4 and 8 on the other hand, it is evident that the cap extension 13 is formed by a number of parallel flow-guiding walls 17 which are spaced apart from one another to a small extent and which are arranged in lamellar fashion with respect to one another. When the insert cartridge 9 is mounted onto the cap 12, the intermediate spaces that remain between the flow-guiding walls 17 connect the inlets 15 to one another, such that the water streams flowing in via the inlets 15 impinge on one another there and are diverted in the cartridge longitudinal direction, where they flow through the free passages or passage openings 18, arranged between the adjacent flow-guiding walls 17 in the direction of the jet nozzle 4, into the cartridge interior.

Between the inlets 15 and the jet nozzle 4 there is provided an insert cartridge 19 which can be inserted into the cartridge interior from that cartridge end region 14 which is open at the face side. The insert cartridge 19 has at least one backflow inhibitor which permits a water flow only in the direction of the jet nozzle 4. The insert cartridge 19 also has a flow rate regulator which has the task of limiting and regulating the amount of water flowing through per unit of time to a certain value, in a manner independent of pressure.

In the case of the backflow inhibitors 1, 100 shown in a longitudinal section in FIGS. 5 and 21, the jet nozzle 4 is guided displaceably in a sleeve-shaped jet nozzle receptacle 50. Said jet nozzle receptacle 50 is connected integrally to the capture part 5 by way of at least one connecting web 51 and preferably two connecting webs 51 arranged parallel to the free jet path 6.

In the case of the backflow inhibitor 100 shown in FIGS. 21 to 27, the jet nozzle receptacle 50 and the capture part 5 connected thereto form an insert element 52 which can be inserted into a shell-shaped housing 53. For this purpose, the housing 53 has an insertion opening 54 on a longitudinal side, through which insertion opening the insert element 52 can be inserted.

The insert element 52 can be detachably fixed in the housing 53 such that the insertion opening 54 simultaneously forms the outlet 8. The jet nozzle receptacle 50 can be closed off, at its face side remote from the jet nozzle 4, by means of a cover 55 which includes an inlet that can be connected to the flow entrance. Said inlet is in this case in the form of a connection nipple 56 which can be connected to the flow entrance via a hose (not shown in any more detail). To ensure that, at all times, there is an adequate distance between the insertion opening 54, which serves as outlet 8, and the respective housing base, at least one spacer may be integrally formed on the housing 53. Here, an embodiment which is not shown is preferred, in which multiple spacers are provided which are arranged in particular in the corner regions of the housing.

As can be seen in FIGS. 21 and 22, a connection nipple 57 or similar outlet is also integrally formed on the capture part 5 in order that the capture part 5 can be connected, for example via a hose line, to the flow exit that leads to a point of use. It can be seen in FIGS. 21 and 22 that, on the capture part 5 and on the connection nipple 57 that serves as outlet, there is provided on the outer circumference a groove 58 which is engaged into by a wall opening 59, which is open toward the insertion opening 54, on the housing face side of the housing 53. Since the insertion opening that borders the wall opening 59 engages into the groove 58, correct positioning of the insert element 52 that is formed from jet nozzle 4 and capture part 5 is ensured at all times.

As can be seen in FIGS. 21 and 22, a guide wall 60 is integrally formed on the outer side of the jet nozzle receptacle 50. In a use position, said guide wall 60, which is engaged on on both sides by one of the connecting webs 51 in each case, bears against a fork-shaped holder 61 which projects into the housing interior of the housing 53. Here, the forks 62 of the holder 61 are arranged on both sides of, and at a distance from, the nozzle opening of the jet nozzle 4 so as not to impair the correct functioning of the jet nozzle 4. Since, in the usage position, the guide wall 60 bears against the holder 61, it is likewise ensured that the insert element 52 is inserted into the housing 53 in correctly positioned fashion. Since the holder 61 is arranged with its forks 62 between the connecting webs 51, the insert element 52 is also secured against rotation in the housing 53.

As can be clearly seen in FIG. 21, in a usage position, the cover 55 that closes off the jet nozzle receptacle 50 at the face side bears against the inner side of the adjacent housing face side of the housing 53. Here, the connection nipple 56 integrally formed on the cover 55 extends through a holding opening 70, which is open toward the insertion opening 54, on the housing face side. The holding opening 70 and also the wall opening, which in the usage position accommodate within them the connection nipples 56, 57, have, at least on one side and preferably on both sides in their opening outline, an offset 71 by means of which the connection nipple 56 or 57 can be detachably locked. The offsets 71 provided on both sides in the opening outline provide the holding opening 70 and also the wall opening 59 with an opening outline which is similar to that of a keyhole intended for a mortise key. Secure hold of the insert element 52 in the housing 53 is ensured in this way.

It is clear from FIGS. 1, 4, 5, 8, 21, 22 and 26 that a conically projecting screen 20 is positioned upstream of the jet nozzle 4. The screen 20, or grate, is of a fine-mesh form such that the different pressures in the water flow over the cross section are homogenized.

The jet nozzle 4 of the backflow inhibitors 1, 100 converts the pressure energy of the water entering from the supply network into the kinetic energy of the water jet. For this purpose, the flow guide narrows in funnel-shaped form in the direction of the nozzle opening 21 of the jet nozzle 4. In the region of the nozzle opening 21, the jet nozzle 4 is in the form of a nipple-like or stud-like projection 22 in order to minimize the influence exerted on the water jet owing to the adhesion forces.

In the free jet path 6, at a distance from the capture part 5 and from the jet nozzle 4, there is arranged at least one spray wall or partition 23 which has a jet passage opening 24 which has a clear cross section larger than the jet cross section of the liquid jet. Here, the clear opening cross section of the jet passage opening 24 is dimensioned such that the liquid jet passes through said jet passage opening 24 without being focused by the latter and just passes through said jet passage opening without making contact. So as not to impair the liquid jet, the spray wall or partition 23 provided at a distance between jet nozzle 4 and capture part 5 is arranged closer to the capture part 5. Here, an embodiment is preferred in which the spray wall or partition 23 is spaced apart from the capture part 5 by at least four millimeters.

The capture part 5 converts the kinetic energy of the water jet passing from the jet nozzle 4 and captured by the capture part 5 into corresponding pressure energy, which is subsequently required for the cleaning or water jet emerging for example from the spray nozzle, from the hand-held shower 45 of an upwardly directed douche or from some other sanitary point of use. From FIGS. 1, 5, 21 and 26, it is clear that the capture part 5, for this purpose, widens in a funnel shape in terms of its clear cross section. The capture part 5 has a capture opening 28 which has a hollow cylindrical clear opening cross section at least in its inflow-side section 25. Adjacent to the hollow cylindrical section 25, the capture part 5 widens in the direction of the flow exit. On the outflow side of the hollow cylindrical section 25, the capture part 5 has subsections 26, 27 which are conical or which widen in arcuate fashion in terms of clear cross section, and of which the inflow-side section 26 widens to a lesser degree than the subsequent subsection 27.

In the case of the backflow inhibitor 1, the capture part 5 leads into a cartridge flow exit 30 arranged on the face-side cartridge end 29, which cartridge flow exit is provided adjacent to the flow exit 7 of the cartridge receptacle 2. In the region of its cartridge end 29 that also includes the cartridge flow exit 30, the insert cartridge 9 is sealed off in encircling fashion against the circumference of the cartridge receptacle 2.

The insert cartridge 9 of the backflow inhibitor 1 can be inserted and fixed in the cartridge receptacle 2 such that the jet nozzle 4 is connected to the flow entrance 3 of the cartridge receptacle 2, and at the same time, the capture part 5 is connected to the flow exit 7 of the cartridge receptacle 2. The insert cartridge 9 of the backflow inhibitor 1, in its cartridge section which is arranged between jet nozzle 4 and capture part 5 and which delimits the free jet path 6, has at least one cartridge opening 11 which is connected to the outlet 8 of the cartridge receptacle 2. By releasing the insert cartridge 9 from the cartridge receptacle 2 and exchanging said insert cartridge 9, the backflow inhibitor 1, whose cartridge receptacle 2 may for example be formed into a toilet seat, a ceramic toilet bowl or a bathtub or which—as is the case here—may be in the form of a housing that can be inserted into a corresponding receptacle on the toilet seat, on the ceramic toilet bowl or on the bathtub opening of a bathtub, can be adapted with little expenditure to a wide variety of predefined conditions, such that optimum functioning is always ensured. By releasing the insert cartridge 9 from the cartridge receptacle 2, the backflow inhibitor 1 is also easy to clean and to descale if required.

The embodiments of the backflow inhibitor 1, 100 illustrated in FIGS. 1 to 4, 5 to 8 and 21 to 27 differ merely in that, in the case of the embodiment shown in FIGS. 5 to 8, the jet nozzle 4 on the one hand and the capture part 5 on the other hand are each in the form of a component that can be detachably inserted into the insert cartridge 9. By virtue of the jet nozzle 4 and capture part 5 being designed as separate components, the modular construction of the backflow inhibitor 1 shown in FIGS. 5 to 8 is promoted such that, if appropriate, it is also possible, by exchanging the jet nozzle 4 and/or the capture part 5, for the insert cartridge 9 to be adapted to the respective conditions of the locally available supply network.

Since, in the case of the other backflow inhibitors 1, 100, the section that forms the free jet path 6 of the insert cartridge 9 or of the insert element 52 is formed only by the two connecting webs 51 oriented in the longitudinal direction, the insert cartridge 9 of the backflow inhibitor 1, or the insert element 52 of the backflow inhibitor 100, is of open form in the region of said free jet path 6. In order that the backflow inhibitors 1, 100 can dry out again quickly after every use, at least one aeration opening is provided in the region of the free jet path 6.

For this purpose, in the case of the backflow inhibitor 1, slot-shaped aeration openings 37 are provided on that side of the cartridge receptacle 2 (shown in FIGS. 1 to 8) which is remote from the outlet 8 of the cartridge receptacle 2, the aeration openings in this case run in labyrinthine form through the wall of the cartridge receptacle 2. By contrast, the housing 53 of the backflow inhibitor 100 shown in FIG. 21 has two slot-shaped aeration openings 63 which are arranged on the longitudinal side remote from the insertion opening 54. Said two slot-shaped aeration openings 63 are oriented, parallel to one another and at a distance from one another, in the housing longitudinal direction. Since the connecting webs 51 of the insert element 52 situated in the housing 53 project into an imaginary plane through the slot-shaped aeration openings 63, it is also the case in the backflow inhibitor 100 that the air is guided through the aeration openings 63 in a labyrinthine manner.

The backflow inhibitors 1, 100 shown here make it possible, with an extremely high level of certainty, to prevent a backflow of contaminated water into a region connected to the drinking water supply network. In order to make it possible for the backflow inhibitor 1, 100 to also be used where such high certainty is not demanded, it is possible for the insert cartridge 9 of the backflow inhibitor 1 in the cartridge receptacle 2 to be exchanged for a sleeve-shaped connecting piece 31 which bridges the free jet path and connects the flow entrance 3 of the cartridge receptacle 2 to the flow exit 7 of the cartridge receptacle 2, possibly with the interposition of an insert cartridge 19 which has at least one backflow preventer.

It is clear from FIGS. 9 to 11 that the modular design of the backflow inhibitor 1 facilitates the exchange of the insert cartridge 9 for a corresponding connecting piece 31. From a comparison of FIGS. 9 and 11, it is clear that the sleeve-shaped connecting piece 31, too, is mounted by way of its open face end onto the cap extension 13 of the cap 12, such that lateral inflow openings 32 are connected via the annular chamber 16 to the flow entrance 3 of the cartridge receptacle 2. Here, the insert cartridge 19 that has been pushed into the connecting piece 31 is secured between the cap extension 13 and an annular shoulder 33 arranged on the inner circumference of the connecting piece 31.

FIGS. 12 to 15 and 21 to 27 illustrate at least that subregion of a differently designed backflow inhibitor 1, 100 which has the jet nozzle 4. As can be seen from FIGS. 12 to 15 and 21 to 27, it is the case in this differently designed backflow inhibitor 1, 100 that the jet nozzle 4 is guided displaceably in the jet nozzle receptacle 50 and can be displaced, under the pressure of the liquid flowing through and counter to a restoring force, from a standby position shown in FIGS. 13 and 14 into a spray position, in which spray position—as shown in FIGS. 15 and 16 and 26 and 27—the jet nozzle 4 extends by way of its nozzle section, which forms the nozzle opening 21 and which is in the form of a projection 22, through a push-through opening 36 provided in an elastic diaphragm 35. Whereas it is the case in the embodiment shown in FIGS. 15 and 16 that the restoring force is imparted to the jet nozzle 4 by a restoring spring 34, it is the case in the embodiment shown in FIGS. 26 and 27 that the elastic material and/or the elastically flexible form of the elastic diaphragm 35 forms the restoring element that acts on the spray nozzle 4.

It can be seen in FIGS. 26 and 27 that, for this purpose, the jet nozzle 4 projects into the diaphragm 35, which in this case is of pot-shaped form and which bears the push-through opening 36 on the pot base of its pot shape. Here, the circumferential margin, remote from the pot base, of the diaphragm 35 is supported in resiliently elastic fashion against the jet nozzle 4. It can be seen in FIGS. 26 and 27 that the diaphragm 35, in the region of the pot base of its pot shape, seals off the jet nozzle receptacle 50 in the region of an opening 64 provided in the guide wall, and that the diaphragm 35, at the circumference of its pot shape, has at least one throughflow opening, and preferably multiple throughflow openings 65 which are spaced apart from one another and which are of slot-shaped form and oriented in the circumferential direction. Said throughflow openings 65 connect the interior 66 of the jet nozzle receptacle 50 to the interior 67 of the pot-shaped diaphragm 35, such that an exchange of liquid between said interiors 66, 67 is permitted during the sliding movement of the jet nozzle 4. To counteract evaporation-induced limescale deposition on the jet nozzles 4 in the region of their nozzle opening 21, it is provided that the jet nozzle 4 is surrounded by water, or washed over by water, when in its standby position shown on the left in FIG. 27.

FIG. 17 shows a backflow inhibitor according to the invention in a schematic partial longitudinal section in the region of its capture part 5. It is clear from FIG. 17 that the capture part 5, in its section bordering the capture opening 28, projects in nipple-like or stud-like form at the outer circumference. It is also shown in FIG. 17 that the capture part 5 has a hollow cylindrical or approximately hollow cylindrical section in the region of its capture opening 28. Here, it may be advantageous for the ratio of the length $l_1$ of said section to the clear inner diameter of the capture opening to be preferably greater than or equal to 0.2 to less than or equal to 10, in particular greater than or equal to 1.5 to less than or equal to 2.6. In FIG. 17, it can also be seen that the capture part 5 widens in preferably funnel-like form adjacent to the hollow cylindrical part. It is provided here that the capture part, on the outflow side of its hollow cylindrical section 25, has at least one section 26, 27 which widens conically in the throughflow direction, and that the section directly adjoining the hollow cylindrical section has a length $l_2$ of 0 up to and including 100 mm, preferably of 0 up to and including 30 mm. In the embodiment illustrated here, it is preferable for the capture part 5 to have at least two sections 26, 27 which widen conically in the throughflow direction, wherein, of at least two mutually adjacent sections 26, 27, at least the outflow-side section, which preferably widens to a relatively great degree, has the length $l_3$ of 0 to 100 mm, preferably of 0 to 30 mm.

It can also be seen in FIG. 17 that the capture part 5, in the region of its section 27 that widens conically to a relatively great degree, has an angle $a_2$ relative to the longitudinal axis of the capture part of greater than/equal to 0 to less than/equal to 45°, preferably of greater than/equal to 0 to less than/equal to 18°. Here, that subsection of the capture part 5 which is provided between said section 27, which widens conically to a relatively great degree, and the hollow cylindrical section 25, which subsection exhibits a relatively small degree of conicity, has an angle $a_1$ relative to the capture part longitudinal axis of greater than/equal to 0 to less than/equal to 45°, preferably of greater than/equal to 0 to less than/equal to 13°.

Said preferred range in the design of the capture part 5 is reflected once again in the table below:

| | Narrowest configuration | Widest configuration |
|---|---|---|
| $l_1/d$ | $1.5 \le l_1/d \le 2.6$ | $0.2 \le l_1/d \le 10$ |
| $l_2$ [mm] | $0 \le l_2 \le 30$ | $0 \le l_2 \le 100$ |
| $l_3$ [mm] | $0 \le l3 \le 30$ | $0 \le l3 \le 100$ |
| $a_1$ (in degrees) | $0 \le a1 \le 13$ | $0 \le a1 \le 45$ |
| $a_2$ (in degrees) | $0 \le a2 \le 18$ | $0 \le a2 \le 45$ |

The backflow inhibitor 1 illustrated here may be connected upstream, at the inflow side, of a douche, and in particular of the upwardly directed douche associated to a toilet seat. Furthermore, however, it is also possible for the backflow inhibitor 1 to be connected upstream, at the inflow side, of the water inflow of a bathtub 38. From the schematic illustration of FIG. 18, it is clear that, in the case of the bathtub 38 illustrated here, the bathtub inlet 39 and the bathtub outlet 40 are provided separately from one another on the tub base of the bathtub 38. It is however also possible for the bathtub inlet 39 and the bathtub outlet 40 to be combined in a common tub opening. Since, in this way, the bathtub inlet 39 is in any case also arranged below the water surface of the bath water situated in the bathtub 38, the bathwater can flow without spray water and quietly into the bathtub 38. However, since the water exerts pressure on the inflowing water and on the bathtub inlet 39 and therefore carries the risk of contaminated bathwater or used water flowing into the water supply network, an effective inflow safeguard must imperatively be ensured in the exemplary embodiment shown in FIG. 18.

The water inlet into the bathtub 38 is operated by way of a manually actuable outlet fitting 41 which combines within it a hot water feed 42 and a cold water feed 43. Once the water passing from the outlet fitting 41 has reached the backflow inhibitor 1, the water flowing through can pass a backflow preventer 44, which is connected between the backflow inhibitor 1 and the bathtub inlet 39, before the water flows, in the bathtub inlet 39, into the bathtub 38 at the base.

In the schematic illustrations of FIGS. 19 and 20, it can be seen that the backflow inhibitor 1 according to the invention can also be connected into the water feed 49, which leads for example to a hand-held shower 45, of an upwardly directed douche which is schematically indicated here. The upwardly directed douche may also possibly be installed retroactively into the ceramic toilet bowl or into the toilet seat.

As has already been stated further above, the jet nozzle 4 of the backflow inhibitor 100 shown in FIGS. 21 to 27 is guided displaceably in the jet nozzle receptacle 50. For this purpose, the jet nozzle receptacle 50 is designed such that, on its side remote from the nozzle opening 21, it can be opened by way of the cover 55. The jet nozzle 4 can be inserted into the interior of the jet nozzle receptacle 50 through the insertion opening of the jet nozzle receptacle 50, which insertion opening is closed by way of the cover 55 in a use position. It can be seen in FIGS. 26 and 27 that the jet nozzle 4 in the backflow inhibitor 100 can, under the pressure of the liquid flowing through and counter to a restoring force, be displaced from the standby position, shown on the left with respect to the longitudinal axis, into the spray position shown to the right thereof, in which spray position the jet nozzle 4 extends, by way of its nozzle section that forms the nozzle opening 21, through the push-through opening 36 provided in the elastic diaphragm 35. The jet nozzle 4, which in this case is of substantially conical form, has an approximately centrally arranged annular shoulder on which the cap-shaped diaphragm 35 is supported. The diaphragm 35, which in this case is of pot-shaped form and is produced from elastic material, is shaped so as to exert the restoring force on the displaceably guided jet nozzle 4. The sliding travel of the jet nozzle 4 in the jet nozzle receptacle 50 is delimited at one side by a screen 20 positioned upstream of the jet nozzle 4 and at the other side by an annular shoulder 47 on the inner circumference of the jet nozzle receptacle 50.

FIGS. 28 to 30 show the jet nozzle 4 of the backflow inhibitor 1 shown in FIGS. 21 to 27. As is clear from a juxtaposition of FIGS. 28 to 30, the jet nozzle 4 has an annular shoulder in the region of its nozzle opening 21. For this purpose, there is integrally formed on the jet nozzle 4 an annular projection 22 which surrounds the nozzle opening 21. The opening margin that borders the nozzle opening of the jet nozzle 4 is of sharp-edged form, and is for this purpose formed without a bevel or rounding. The opening margin of the nozzle opening 21 has, for this purpose, an edge degree of less than 0.1 mm or greater than −0.1 mm. Since the nozzle opening and the opening margin that borders the nozzle opening are arranged upstream of the annular projection 22 as viewed in the flow direction, and since the annular projection 22 thus protects the sharp edge of the border margin bordering the nozzle opening 21, any possible damage to the nozzle opening 21 and of its sharp-edged opening margin is prevented during the production of the spray nozzle 4. The sharp-edged opening margin forms a separation edge provided on the inner circumference, which separation edge promotes the formation of a sharply formed and non-sputtering liquid jet in the jet nozzle 4.

LIST OF REFERENCE NUMERALS

1 Backflow inhibitor (according to FIGS. 1 to 20)
2 Cartridge receptacle
3 Flow entrance (of the cartridge receptacle 2)
4 Jet nozzle
5 Capture part
6 Jet path
7 Flow exit (of the cartridge receptacle 2)
8 Outlet
9 Insert cartridge
10 Insertion opening (of the cartridge receptacle 2)
11 Cartridge opening
12 Cap
13 Cap extension
14 Cartridge end region
15 Cartridge inlet
16 Annular chamber
17 Flow-guiding walls
18 Passage opening
19 Insert cartridge
20 Screen
21 Nozzle opening
22 Projection (of the jet nozzle 4)
23 Spray wall or partition
24 Jet passage opening (in the spray wall or partition)
25 (Hollow cylindrical) subsection
26 (Conical) subsection
27 Subsection or transition section (with slight conicity)
28 Capture opening
29 Cartridge end
30 Cartridge flow exit
31 (Sleeve-shaped) connecting piece
32 Inlet openings
33 Annular shoulder
34 Restoring spring
35 Diaphragm
36 Push-through opening
37 Aeration opening
38 Bathtub
39 Bathtub inlet
40 Bathtub outlet
41 Outlet fitting
42 Hot water feed
43 Cold water feed
44 Backflow preventer
45 Hand-held shower
47 Annular shoulder
48 Shut-off element
49 Water feed
50 Jet nozzle receptacle
51 Connecting web
52 Insert element
53 Housing
54 Insertion opening
55 Cover
56 Connection nipple (as inlet)
57 Connection nipple (as outlet)
58 Groove
59 Wall opening
60 Guide wall
61 Holder
62 Fork (of the holder 61)
63 Aeration opening (of the backflow inhibitor 100)
64 Opening (in the guide wall 60)
65 Throughflow opening
66 Interior (of the jet nozzle receptacle 50)

67 Interior (of the pot-shaped diaphragm 35)
68 Spacer
69 Throughflow opening
70 Holding opening
71 Offset
100 Backflow inhibitor (according to FIGS. 21 to 27)

The invention claimed is:

1. A backflow inhibitor (1, 100) having a jet nozzle (4) connectable to a flow entrance (3) and a capture part (5) which captures a liquid jet that passes over a free jet path (6) from the jet nozzle (4), said capture part is connectable or connected to a flow exit (7; 57) and to an outlet (8) arranged below the free jet path (6), said outlet (8) discharges a partial amount of liquid that is not captured by the capture part (5), in which at least one spray wall or partition (23) is arranged in the free jet path (6), at a distance from the jet nozzle (4) and from the capture part (5), said spray wall or partition (23) having a jet passage opening (24), wherein the jet passage opening (24) provided in the spray wall or partition (23) has a clear opening cross section larger than the jet cross section of the liquid jet, and wherein the clear opening cross section of the jet passage opening (24) is dimensioned such that the liquid jet passes through said jet passage opening (24) and without contacting said spray wall or partition (23).

2. A backflow inhibitor (1, 100) having a jet nozzle (4) connectable to a flow entrance (3) and a capture part (5) which captures the liquid jet that passes over a free jet path (6) from the jet nozzle (4), said capture part is connectable or connected to a flow exit (7; 57) and to an outlet (8) arranged below the free jet path (6), said outlet (8) discharges a partial amount of liquid that is not captured by the capture part (5), as claimed in claim 1, wherein the jet nozzle (4) is displaceable in the backflow inhibitor (1, 100) from a standby position into a spray position, in said spray position, a forward portion having a nozzle opening (21) of the jet nozzle (4), extends through a push-through opening (36) which is provided in an elastic diaphragm (35) or the jet nozzle opening (21) is closed by a flap of the elastic diaphragm (35) in the standby position.

3. The backflow inhibitor as claimed in claim 2, wherein a sleeve-shaped jet nozzle receptacle (50) is provided in which the jet nozzle (4) is displaceable and wherein the jet nozzle receptacle (50) is connected to the capture part (5) via at least one connecting web (51).

4. The backflow inhibitor as claimed in claim 2, in the standby position, the forward portion of the jet nozzle (4), having the nozzle opening (21), is arranged in a water bath or is surrounded by water, and wherein the flap of the diaphragm closes the push-through opening in the standby position.

5. The backflow inhibitor as claimed in claim 2, wherein the jet nozzle (4) is displaced from the standby position into the spray position counter to a restoring force.

6. The backflow inhibitor as claimed in claim 2, wherein the jet nozzle (4) is displaceable under a pressure of the liquid flowing through.

7. The backflow inhibitor as claimed in claim 5 wherein, the restoring force is provided by at least one restoring spring (34).

8. The backflow inhibitor as claimed in claim 5, wherein the restoring force which acts on the jet nozzle (4), is provided by the diaphragm (35).

9. The backflow inhibitor as claimed in claim 5, wherein the jet nozzle (4) projects into a pot-shaped diaphragm (35) which bears a passage opening (36) on a base of its pot shape, and wherein a circumferential margin, remote from the pot base, of the diaphragm (35) is biased against the jet nozzle (4).

10. The backflow inhibitor as claimed in claim 9, wherein the diaphragm (35), in a region of the base of its pot shape, seals off the jet nozzle receptacle (50) in a region of an opening (64) provided in a guide wall (60), and wherein the diaphragm (35), at a circumference of its pot shape, has at least one throughflow opening (65) which connects the interior (66) of the jet nozzle receptacle (50) to the interior (67) of the pot-shaped diaphragm (35).

* * * * *